US006196743B1

(12) United States Patent
Brucker

(10) Patent No.: US 6,196,743 B1
(45) Date of Patent: Mar. 6, 2001

(54) SUN TAN APPLICATOR AND CONTAINER

(76) Inventor: Lynn M. Brucker, 1103 Fayette Ave., Scottdale, PA (US) 15683

( * ) Notice: Subject to any disclaimer, the term of this patent is extended or adjusted under 35 U.S.C. 154(b) by 0 days.

(21) Appl. No.: 09/410,778

(22) Filed: Oct. 1, 1999

(51) Int. Cl.[7] ..... A46B 5/02
(52) U.S. Cl. ..... 401/6; 401/208; 401/122; 401/118
(58) Field of Search ..... 401/6, 121, 122, 401/126, 268, 118

(56) References Cited

U.S. PATENT DOCUMENTS

| | | | | |
|---|---|---|---|---|
| 2,034,416 | * | 3/1936 | Peat | 401/126 |
| 4,276,718 | * | 7/1981 | Keeton et al. | 401/126 |
| 4,403,624 | * | 9/1983 | Montgomery | 401/122 |
| 4,869,612 | * | 9/1989 | Mooney et al. | 401/6 |
| 5,810,027 | * | 9/1998 | Frantzeskakis | 401/208 |
| 5,931,590 | * | 8/1999 | Harris | 401/6 |

FOREIGN PATENT DOCUMENTS

| | | | | |
|---|---|---|---|---|
| 75526 | * | 6/1893 | (DE) | 401/122 |

* cited by examiner

*Primary Examiner*—David J. Walczak
(74) *Attorney, Agent, or Firm*—Clifford A. Poff

(57) ABSTRACT

An apparatus for applying a sun tan lotion to a hard to reach area of a user's skin having an applicator rotatably supported by a shaft extending from an elongated handle traversing a user's palm, the applicator having a compressible layer of closely spaced wick-like absorbent fiber bundles extending generally outwardly from a mat supported on a hollow cylindrical base, the base including a split cylinder grip member contained in a channel along an inner surface for frictional retention of the shaft, the apparatus also including a container for immersion of the applicator in a supply of lotion having an inner surface sufficient in size to create a clearance around an immersed applicator for non-piston travel of the applicator and an opening sized for interference with the compressible layer of the applicator, the apparatus further including an exit reservoir extending from said opening having an outwardly expanding portion for containment and return of liquid separated from said applicator externally of the opening of the container.

22 Claims, 2 Drawing Sheets

SUN TAN APPLICATOR AND CONTAINER

BACKGROUND OF THE INVENTION

1. Field of the Invention

The present invention relates generally to a liquid applicator and container and more particularly to an applicator and container suited for the application of a sun tan lotion to an area of a user's skin.

2. Description of the Prior Art

The prior art of sun tan lotion applicators, as seen in U.S. Pat. No. 5,470,163 to Komala and U.S. Pat. No. 4,869,612 to Mooney, discloses the use of an applicator supporting sponge material for immersion in a supply of sun tan lotion housed in a container. The prior art teaches that the sponge material which has absorbed lotion is wiped across a surface of the skin for application of the lotion carried by the sponge material. See, for example, the construction of the frame 22 supporting applicator arms 22 for wiping application in the Komala patent and the teaching of Mooney regarding wiping application, at Col. 1, lines 47–49, that the "applicator should also provide a soothing feel resembling that of human skin to massage the liquid into the skin."

The prior art does not disclose the use of a compressible layer of closely spaced wick-like members of absorbent material forming a compressible layer to apply a sun tan lotion through rolling contact between the applicator and a surface of skin which offers advantages over the use of a wiped sponge including assurances of uniformly applying a sufficiently thick layer of lotion for protection against skin damage caused by ultraviolet radiation from exposure to the sun as well as providing an applicator which can carry a sufficient amount of lotion to apply a layer of lotion over a large area of skin. Such an increase in carrying capability offers the advantage of coverage of a large area of skin without the need for re-immersion of the applicator in the supply of sun tan lotion.

It is known in the prior art, as disclosed in the Mooney patent, to size the opening of the container which houses the supply of sun tan lotion such that an interference creates compression on the applicator for removal of excess liquid from a saturated applicator. The prior art, however, does not disclose providing an exit reservoir extending from the opening of the container to provide a contained clearance around an exiting applicator for capture and return to the container of either extracted liquid which is forced through the opening with the exiting applicator or liquid which is separated from the applicator beyond the opening as the applicator returns to an unrestrained configuration upon release of the compression.

It is therefore an object of the present invention to provide an apparatus for applying a liquid, such as a sun tan lotion, to an area of a user's skin.

It is a further object of the present invention to provide an apparatus which facilitates application of a sun tan lotion to a hard to reach area of skin, such as the back of a user.

It is a further object of the present invention to provide an apparatus having a rotatably supported applicator for applying a sun tan lotion through rolling contact between a layer of saturated material and a user's skin offering the advantage of uniform coverage over the area of skin essentially assuring a minimum layer to utilize the effective ultraviolet protection afforded by the composition of the lotion.

It is still a further object of the present invention to provide an apparatus for applying a sun tan lotion to hard to reach areas of a user's skin having an applicator including a compressible layer of closely spaced wick-like members of absorbent material providing the advantages of retention of a large amount of lotion and uniform application of lotion over a large area of skin without the need for re-immersion of the applicator in a supply of sun tan lotion.

It is yet a further object of the present invention to provide an apparatus for applying a sun tan lotion to a user's skin which includes a container for immersion of an applicator in a supply of lotion having an opening sized for interference with a compressible and absorbent layer of an applicator to remove an excess portion of lotion and an exit reservoir extending from the opening to contain and return lotion separated from the applicator which is either forced through the opening with the applicator or ejected from the compressible layer upon release from the interference with the opening, the combination of the container and exit reservoir offering the advantages of efficiently saturating the applicator and neatly containing the lotion separated from an exiting applicator.

SUMMARY OF THE INVENTION

According to the present invention there is provided an apparatus for applying a liquid, such as a sun tan lotion, to a user's body. The apparatus includes: an elongated handle having a central axis and a length sufficient to traverse the palm of a user for control of the apparatus; an elongated shaft extending from the handle and having a central axis which is generally coincident with the central axis of the handle; an applicator rotatably supported by the shaft having a compressible portion at an outer periphery thereof, the compressible portion including a cylindrical mat and a plurality of closely spaced absorbent wick-like members secured to the cylindrical mat for generally outward extension therefrom; and a container for housing the applicator and a supply of the liquid.

In a preferred embodiment of the present invention, the container of the apparatus includes an opening sized for interference between at least a portion of the compressible portion of the applicator and the opening for applying compression to the compressible portion to extract an excess portion of the liquid from the applicator upon removal of the applicator from the container. The preferred apparatus according to the present invention also includes an exit reservoir extending outwardly from the opening of the container, the exit reservoir having an outwardly expanding portion with respect to the opening of the container for containment and return of a portion of the extracted excess portion of liquid which is either forced through the opening or separated from the compressible portion of the applicator upon release of the compressible portion from the compression.

The container according to a preferred embodiment of the present invention has an internal surface providing sufficient clearance around the applicator to provide for non-piston travel of an applicator immersed in liquid housed in the container whereby a portion of liquid forwardly of a traveling applicator is redistributed rearwardly with respect to the applicator.

The apparatus according to a preferred embodiment of the present invention includes a hollow cylindrical base having an outer surface to which the mat is secured and an opposite inner surface, the applicator including a split cylinder grip member rotatably supported in a channel along the inner surface of the base, the grip member establishing compression between the grip member and the shaft upon insertion of shaft in the inner surface of the base for frictional retention of the grip member on the shaft.

BRIEF DESCRIPTION OF THE DRAWINGS

These features and advantages of the present as well as others will be more fully understood when the following description is read in light of the accompanying drawings in which.

DETAILED DESCRIPTION OF THE PREFERRED EMBODIMENTS

Figure 3:
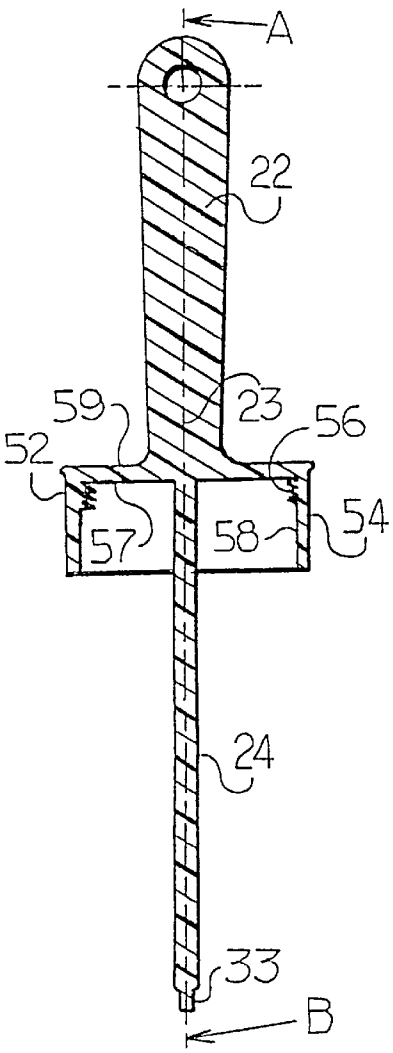
FIG. 3 is a sectional view of the handle, shaft and cap of the applicator assembly of FIG. 2.
Figure 2:
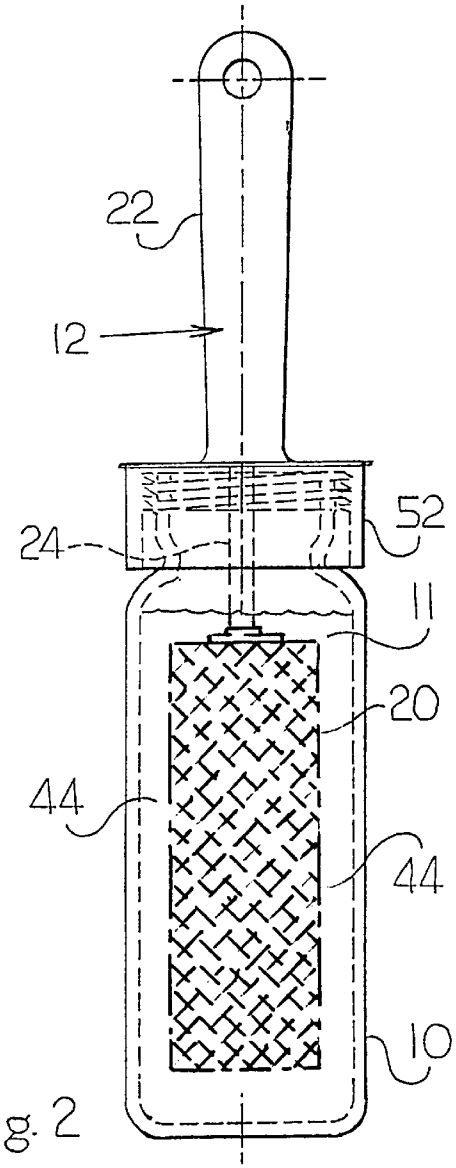
FIG. 2 is an elevational view of the apparatus of FIG. 1 illustrating the applicator assembly of FIG. 1 secured to the container of FIG. 1 housing a supply of a sun tan lotion.
Figure 1:
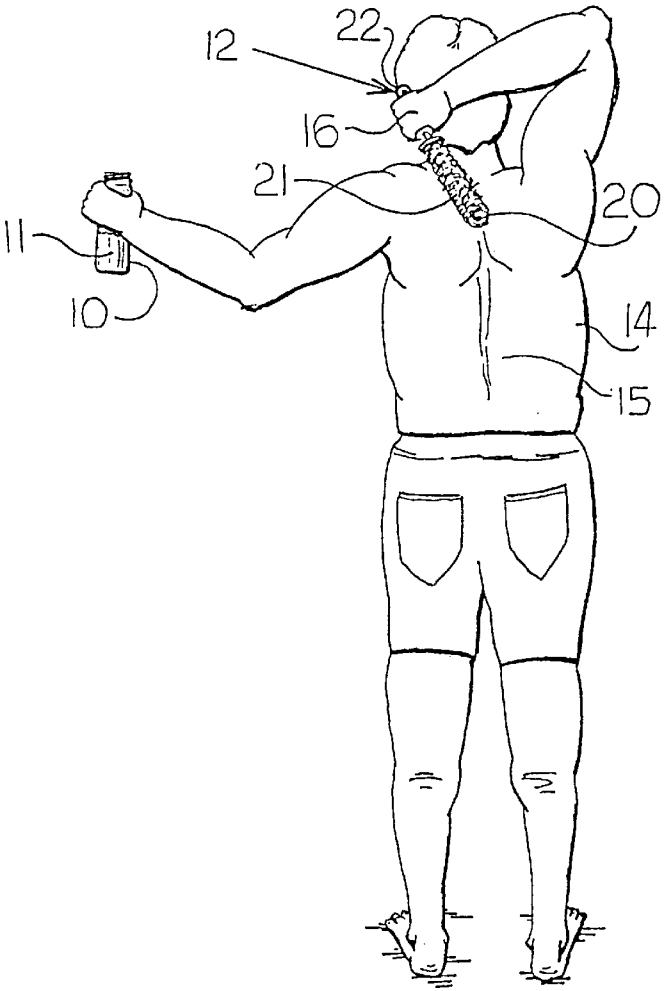
FIG. 1 illustrates an apparatus according to the present invention being used by a person to apply a sun tan lotion to a hard to reach area of skin of the person.
Figure 7:
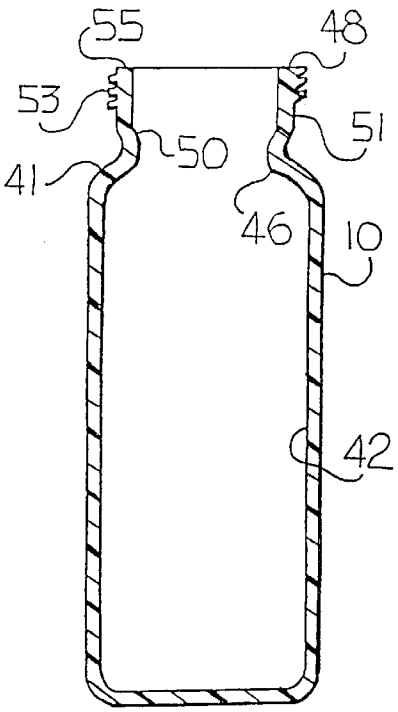
FIG. 7 is a sectional view of the container of FIG. 2.
Figure 5:
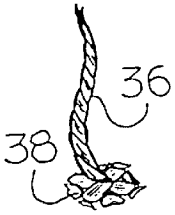
FIG. 5 is an illustration of an individual wick-like member of the applicator of FIGS. 4A and 4B shown in isolation from other closely spaced wick-like members to illustrate the securement of the wick-like member to the mat of the applicator.
Figure 6:
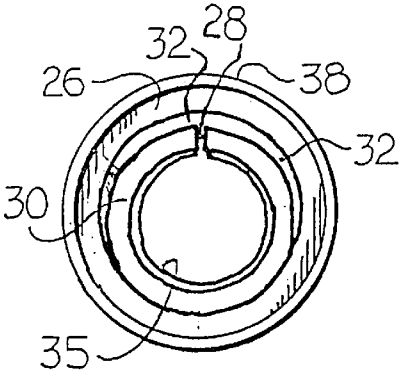
FIG. 6 is a sectional view of the applicator of FIG. 4B taken through the base at the location of the grip member.
Figure 4B:
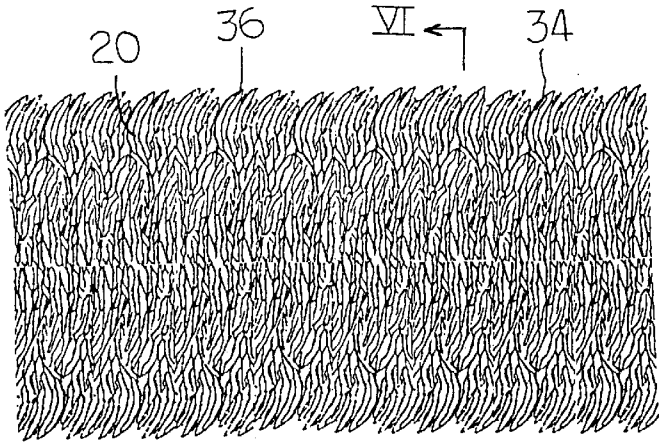
FIGS. 4A and 4B are an end view and a elevational view, respectively of the applicator of FIG. 2.
Figure 4A:
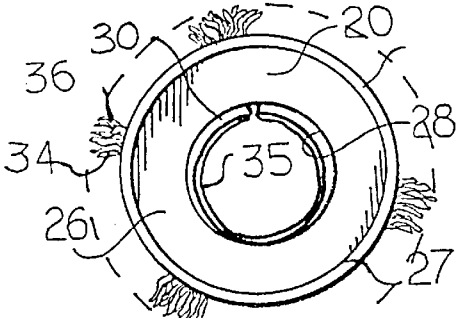

In FIG. 1 there is shown an apparatus according to the present invention having a container 10 housing a liquid sun tan lotion 11 and an applicator assembly 12 which is being used to apply the sun tan lotion to an area of skin of a user 14 of the apparatus. The apparatus is useful for applying a sun tan lotion to hard to reach areas of the user's body such as the back 15 as illustrated in FIG. 1.

In FIGS. 2 to 7, the construction of the apparatus can be seen in greater detail. The applicator assembly 12 includes an applicator 20 which is rotatably secured to a handle 22 which is elongated to extend along a central axis, A. As seen in FIG. 1, the handle has a length sufficient to traverse the palm of a user's hand 16 to provide for control of the applicator for access to a hard to reach area of the user's body and rolling contact between an outer portion 21 of applicator 20 and an area of skin of the user 14 to apply the lotion 11 to the area. The applicator assembly includes an elongated shaft 24 extending from an end 23 of handle 22 such that a central axis, B, of shaft 24 is generally coincident with the central axis, A of the handle. Although the handle and shaft are shown as integral in construction, it is conceivable that the handle and shaft could be separate members joined by a threaded connection or a bonded connection, such as glue, for examples.

The applicator 20 includes a hollow cylindrical base 26 having an outer surface 27 and an inner surface 28. A grip member 30 is rotatably contained within an annular channel 32 formed in the inner surface 28 of base 26. The grip member 30 is preferably a split cylinder which is expanded outwardly in channel 32 upon insertion of shaft 24 to create compression between the grip member 30 and shaft 24 and frictional securement of the grip member 30 on shaft 24. An end 33 of shaft 24 is reduced in size, as by tapering, to allow for insertion of shaft 24 within an unrestrained grip member within the channel 32. An inner surface of grip member 30 includes spaced apart annular projections 35 to enhance the gripping effect on the shaft without loss of rotatable containment of the gripper member 30 within the annular channel 32. The intermediate location of grip member 30 with respect to base 26 provides for a range of positions of rotatable securement of base 26 on shaft 24 allowing for adjustment in the position of applicator 20 with respect to handle 22.

The applicator 20 includes a compressible portion 34 about an outer periphery thereof for conveying a portion of lotion 11 for release to an area of a user's body upon rolling contact therewith. The compressible portion 34 includes closely spaced absorbent wick-like members 36 extending generally outwardly from a mat 38 secured to the outer surface 27 of base 26 by gluing, for example. The absorbent wick-like members 36 are most preferably bundled fibers, such as of cotton. The wick-like members 36 are preferably secured to the mat 38 by hot melt adhesion or by other securement means per se well known in the art.

The apparatus includes a container 10 for housing the applicator 20 and a supply of sun tan lotion 11. The container 10 has an inner surface 42 which is large with respect to the compressible portion 34 of applicator 20 such that a clearance 44 exists between the applicator 20 and container 10 which is sufficient to provide for non-piston travel of the applicator when immersed in liquid 11 within container 10 in which liquid forwardly of the traveling applicator is redirected rearwardly with respect to the applicator within the clearance 44.

The container 10 includes an opening 46 at an end 41 which is small in size with respect to the unrestrained dimensions of compressible portion 34 of applicator 20 such that an interference fit will be created between the compressible portion 34 and the opening 46 upon passage of the applicator through the opening. This provides for compression of an immersed applicator upon removal of the applicator from the container for extraction of an excess portion of lotion 11.

The apparatus also includes an exit reservoir 48 extending from opening 46 of container 10. The exit reservoir 48 includes portion 50 which expands outwardly from opening 46 of container 10 to provide a contained clearance between an unrestrained compressible portion 34 of applicator 20 and the exit reservoir 48 for containment of any extracted lotion which is forced through the opening 46 with an exiting applicator 20 upon removal of an immersed applicator from the container 10 and return of the liquid to the container. The exit reservoir 48 will also contain any liquid which becomes separated from the wick-like members 36, in the form of spray for example, as the wick-like members are released to an unrestrained position after being released from the compression applied by the interference at opening 46. Gravity forces acting on the separated liquid contained in exit reservoir 48 will cause the separated liquid to be returned to the container 10 through opening 46.

The apparatus 10 further includes a cap 52 extending from end 23 of handle 22. A cylindrical wall 54 of cap 52 has threaded portion 56 located on an inner surface 58 for engagement with a threaded portion 53 located on an outer surface 51 of portion 50 of exit reservoir 48. A seal is provided by contact between an end face 55 of exit reservoir 48 and surface 57 of a top portion 59 of cap 52.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

I claim:

1. An apparatus for applying a liquid, such as a sun tan lotion, to a user's body, the apparatus including:

an elongated handle having a central axis and a length sufficient to traverse the palm of a user for control of said handle;

an elongated shaft extending from said handle and having a central axis which is generally coincident with the central axis of said handle;

an applicator rotatably supported by said shaft, said applicator having a compressible portion at an outer periphery thereof, said compressible portion including a cylindrical mat and a plurality of closely spaced absorbent wick-like members secured to said cylindrical mat for generally outward extension therefrom; a rotatable gripper rotatably contained on an inner periphery of said cylindrical mat while compressively engaged with said elongated shaft; and a container for housing said applicator and a supply of the liquid.

2. The apparatus according to claim 1 wherein said container has an internal surface providing sufficient clearance around said applicator to provide for non-piston travel of an applicator immersed in liquid housed in said container whereby a portion of liquid forwardly of a traveling applicator is redistributed rearwardly with respect to the applicator.

3. The apparatus according to claim 1 wherein said container has an opening sized for interference between at least a portion of the compressible portion of said applicator and said opening for applying compression to the compressible portion to extract an excess portion of the liquid from said applicator upon removal of said applicator from said container.

4. The apparatus according to claim 3 further including an exit reservoir extending outwardly from the opening of said container, said exit reservoir having an outwardly expanding portion with respect to the opening of said container for containment and return of a portion of the extracted excess portion of liquid which is either forced through said opening or separated from the compressible portion of said applicator upon release of the compressible portion from the compression.

5. The apparatus according to claim 4 further including a cap secured to said handle having a threaded portion and wherein said exit reservoir includes a threaded portion to which the threaded portion of said cap is engagable.

6. The apparatus according to claim 5 wherein said cap and said exit reservoir include opposing seal surfaces for providing an airtight enclosure upon contact between the respective seal surfaces.

7. An apparatus for applying a liquid, such as a sun tan lotion, to a user's body, the apparatus including:

an elongated handle having a central axis and a length sufficient to traverse the palm of a user for control of said handle;

an elongated shaft extending from said handle and having a central axis which is generally coincident with the central axis of said handle;

an applicator rotatably supported by said shaft, said applicator having a compressible portion at an outer periphery thereof said compressible portion including a cylindrical mat and a plurality of closely spaced absorbent wick-like members secured to said cylindrical mat for generally outward extension therefrom:

the applicator includes a hollow cylindrical base having an outer surface to which said mat is secured and an opposite inner surface, the applicator further including a grip member rotatably supported in a channel along the inner surface of said base, said grip member establishing compression between said grip member and said shaft upon insertion of shaft in the inner surface of said base for frictional retention of said grip member on said shaft; and a container for housing said applicator and a supply of the liquid.

8. The apparatus according to claim 7 wherein said grip member includes a split cylinder which is expanded outwardly upon insertion of said shaft within an inner surface of the split cylinder for said compression between said grip member and said shaft.

9. The apparatus according to claim 8 wherein said grip member includes at least one annular projection extending from the inner surface.

10. The apparatus according to claim 7 wherein said container has an internal surface providing sufficient clearance around said applicator to provide for non-piston travel of an applicator immersed in liquid housed in said container whereby a portion of liquid forwardly of a traveling applicator is redistributed rearwardly with respect to the applicator.

11. The apparatus according to claim 7 wherein said container has an opening sized for interference between at least a portion of the compressible portion of said applicator and said opening for applying compression to the compressible portion to extract an excess portion of the liquid from said applicator upon removal of said applicator from said container.

12. The apparatus according to claim 11 further including an exit reservoir extending outwardly from the opening of said container, said exit reservoir having an outwardly expanding portion with respect to the opening of said container for containment and return of a portion of the extracted excess portion of liquid which is either forced through said opening or separated from the compressible portion of said applicator upon release of the compressible portion from the compression.

13. The apparatus according to claim 12 further including a cap secured to said handle having a threaded portion and wherein said exit reservoir includes a threaded portion to which the threaded portion of said cap is engagable.

14. The apparatus according to claim 13 wherein said cap and said exit reservoir include opposing seal surfaces for providing an airtight enclosure upon contact between the respective seal surfaces.

15. An apparatus for applying a liquid, such as a sun tan lotion, to a user's body, the apparatus including:

an applicator having a plurality of closely spaced and liquid absorbent wick-like members secured to an outer periphery of a cylindrical mat to form an outwardly extending compressible portion for dispensing liquid retained by said wick-like members;

a container for housing said applicator and a supply of liquid;

an elongated handle with a central axis extending along the extended length thereof, said handle having a length sufficient to traverse the palm of a user's hand;

an elongated shaft extending from said handle and having a central axis which is generally coincident with the central axis of said handle; and a rotatable gripper rotatably contained on an inner periphery of said cylindrical mat while compressively engaged with said elongated shaft to join said elongated handle with said applicator for releasing liquid to an area of a user's body by rolling contact with said compressible portion.

16. The apparatus according to claim 15 further including an annular channel in the inner periphery of said cylindrical mat for rotatably receiving said rotatable gripper.

17. The apparatus according to claim 16 wherein said elongated shaft includes an end portion having a reduced size for entry in said rotatable gripper.

18. The apparatus according to claim 15 wherein said container has an internal surface providing sufficient clearance around said applicator to provide for non-piston travel of an applicator immersed in liquid housed in said container whereby a portion of liquid forwardly of a traveling applicator is redistributed rearwardly with respect to the applicator.

19. The apparatus according to claim 15 wherein said container has an opening sized for interference between at least a portion of the compressible portion of said applicator and said opening for applying compression to the compressible portion to extract an excess portion of the liquid from said applicator upon removal of said applicator from said container.

20. The apparatus according to claim 19 further including an exit reservoir extending outwardly from the opening of said container, said exit reservoir having an outwardly expanding portion with respect to the opening of said container for containment and return of a portion of the extracted excess portion of liquid which is either forced through said opening or separated from the compressible portion of said applicator upon release of the compressible portion from the compression.

21. The apparatus according to claim 20 further including a cap secured to said handle having a threaded portion and wherein said exit reservoir includes a threaded portion to which the threaded portion of said cap is engagable.

22. The apparatus according to claim 21 wherein said cap and said exit reservoir include opposing seal surfaces for providing an airtight enclosure upon contact between the respective seal surfaces.

* * * * *